US010798789B2

(12) United States Patent
Queen

(10) Patent No.: US 10,798,789 B2
(45) Date of Patent: Oct. 6, 2020

(54) STEAM CLEANING SYSTEM

(71) Applicant: Kenneth Queen, Aurora, CO (US)

(72) Inventor: Kenneth Queen, Aurora, CO (US)

( * ) Notice: Subject to any disclaimer, the term of this patent is extended or adjusted under 35 U.S.C. 154(b) by 193 days.

(21) Appl. No.: 15/451,945

(22) Filed: Mar. 7, 2017

(65) Prior Publication Data

US 2018/0263085 A1 Sep. 13, 2018

(51) Int. Cl.

| | |
|---|---|
| ***H05B 6/64*** | (2006.01) |
| ***H05B 6/80*** | (2006.01) |
| ***A47L 13/17*** | (2006.01) |
| ***B08B 9/087*** | (2006.01) |
| ***F24C 14/00*** | (2006.01) |
| ***B08B 9/00*** | (2006.01) |

(52) U.S. Cl.

CPC ..... *H05B 6/6405* (2013.01); *B08B 9/00* (2013.01); *B08B 9/087* (2013.01); *F24C 14/00* (2013.01); *B08B 2230/01* (2013.01); *F24C 14/005* (2013.01)

(58) Field of Classification Search

CPC ..... A47L 13/17; F24C 14/00; H05B 6/64; H05B 6/6402; H05B 6/6405; B08B 7/02

USPC ..... 219/682, 678, 679; 134/1, 2, 11, 12, 17, 134/31, 34, 35; 422/1, 21; 428/2, 34; 229/5.81, 903; 126/221

See application file for complete search history.

(56) References Cited

U.S. PATENT DOCUMENTS

| | | | | |
|---|---|---|---|---|
| 4,721,140 | A * | 1/1988 | Coker | A47G 19/26 150/154 |
| 5,353,781 | A * | 10/1994 | Calvillo | F24C 15/12 126/221 |
| 6,444,963 | B1 | 9/2002 | Donahue | |
| 6,656,288 | B2 | 12/2003 | Cherry | |
| 6,878,910 | B2 | 4/2005 | Kim et al. | |
| 7,002,120 | B2 | 2/2006 | Cherry | |
| 7,087,871 | B2 * | 8/2006 | Cherry | A47L 13/17 134/1 |
| 2005/0235405 | A1 * | 10/2005 | Dolle | E03D 9/00 4/300.3 |
| 2008/0235893 | A1 | 10/2008 | Menzies | |
| 2012/0255575 | A1 | 10/2012 | Hanson | |

FOREIGN PATENT DOCUMENTS

| | | | |
|---|---|---|---|
| JP | 10314092 | A * | 12/1998 |
| JP | 2008101311 | A * | 5/2008 |

* cited by examiner

*Primary Examiner* — Quang T Van

(57) ABSTRACT

A steam cleaning system for cleaning a microwave oven without chemical cleaners includes an oven. A bowl is provided that contains a liquid and the bowl is selectively positioned within the oven. The oven boils the liquid thereby producing steam. The steam penetrates debris stuck to the oven thereby facilitating the debris to be cleaned from the oven. A cloth is provided and the cloth is selectively positioned in the bowl. The cloth is made of a liquid permeable material such that the cloth absorbs the liquid. Moreover, the steam is released from the cloth when the oven is turned on to heat the liquid.

3 Claims, 4 Drawing Sheets

STEAM CLEANING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning devices and more particularly pertains to a new cleaning device for cleaning a microwave oven without chemical cleaners.

BRIEF SUMMARY OF THE INVENTION

An embodiment of the disclosure meets the needs presented above by generally comprising an oven. A bowl is provided that contains a liquid and the bowl is selectively positioned within the oven. The oven boils the liquid thereby producing steam. The steam penetrates debris is stuck to the oven thereby facilitating the debris to be cleaned from the oven. A cloth is provided and the cloth is selectively positioned in the bowl. The cloth is comprised of a liquid permeable material such that the cloth absorbs the liquid. Moreover, the steam is released from the cloth when the oven is turned on to heat the liquid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
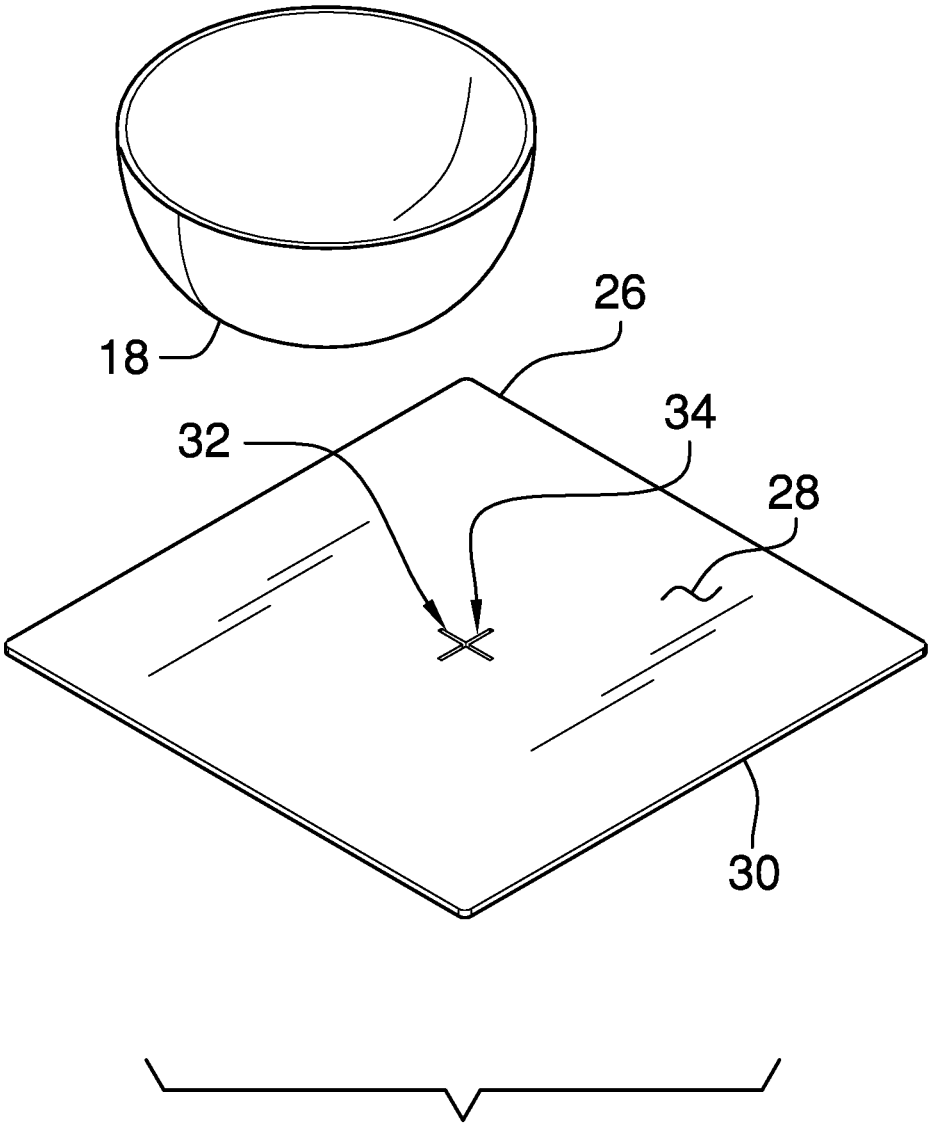
FIG. 1 is a perspective view of a bowl and a cloth of a steam cleaning system according to an embodiment of the disclosure.
Figure 2:
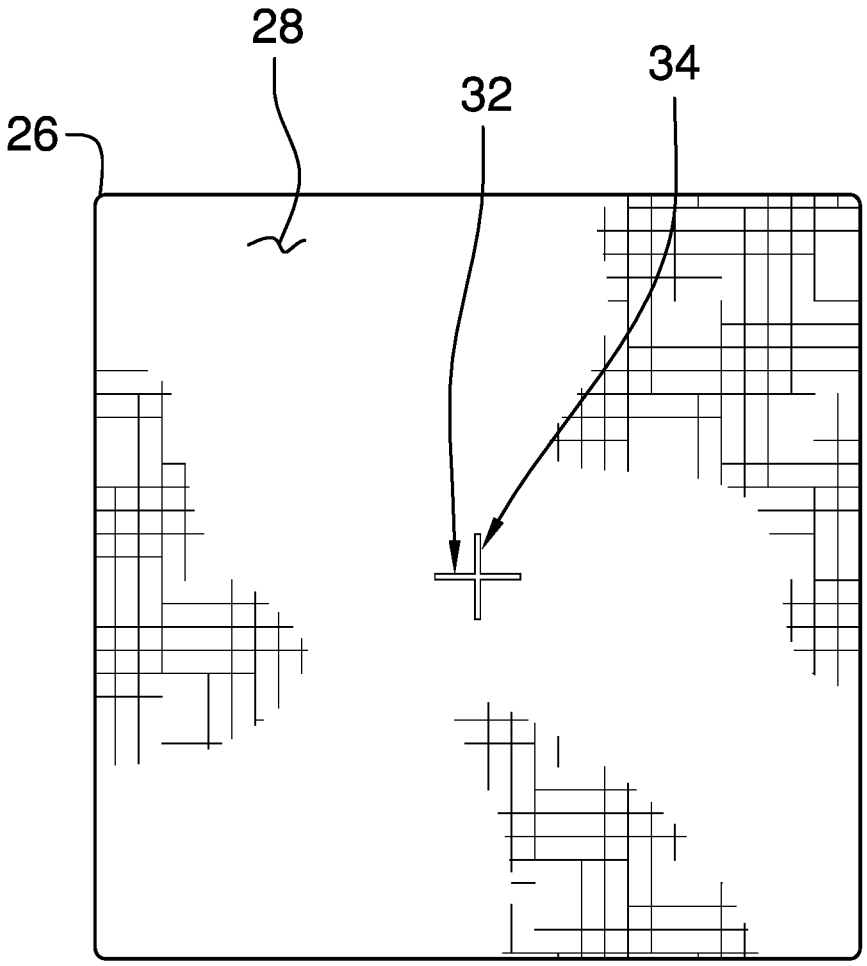
FIG. 2 is a top view of cloth of an embodiment of the disclosure.
Figure 3:
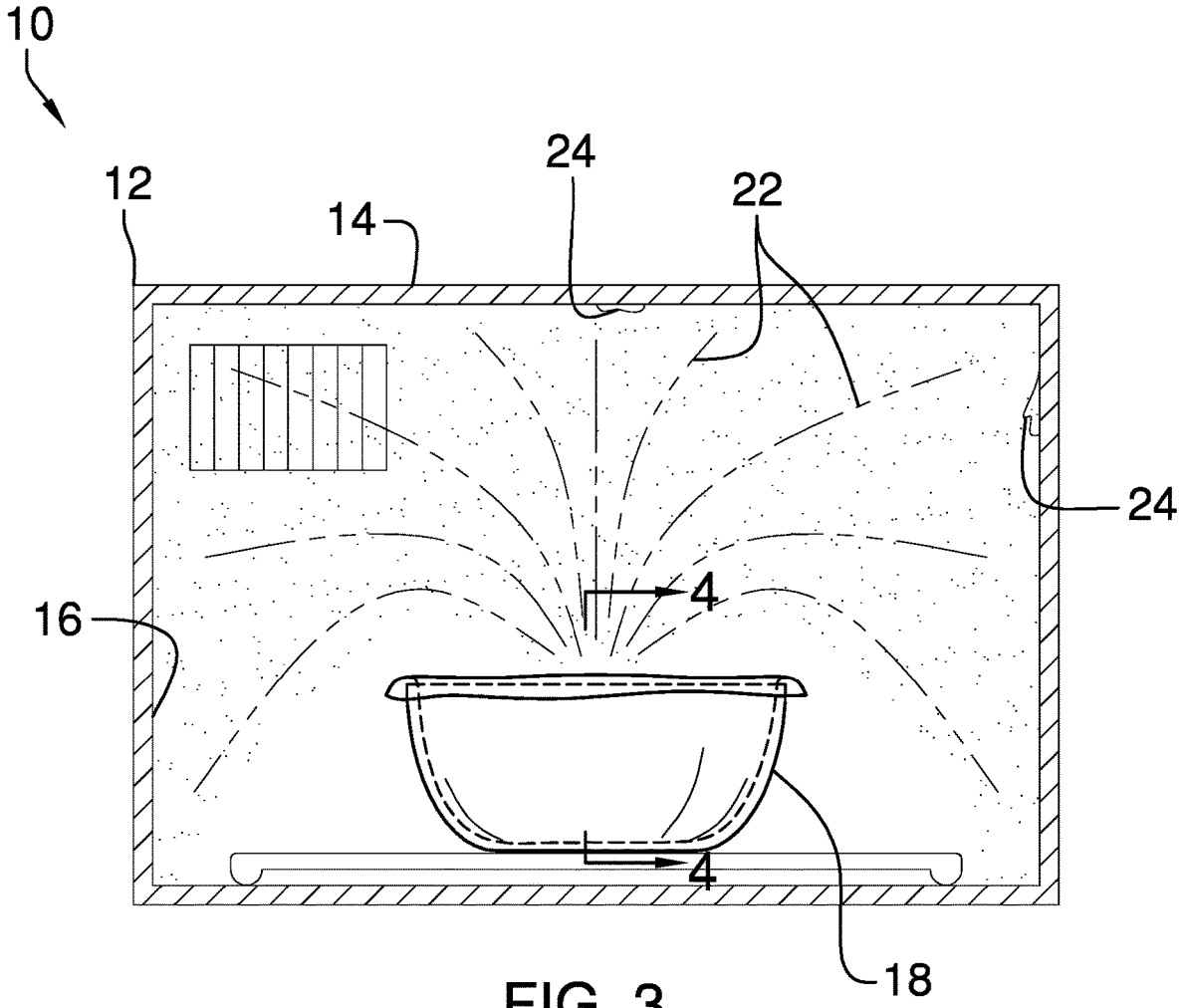
FIG. 3 is a perspective in-use view of an embodiment of the disclosure.
Figure 4:
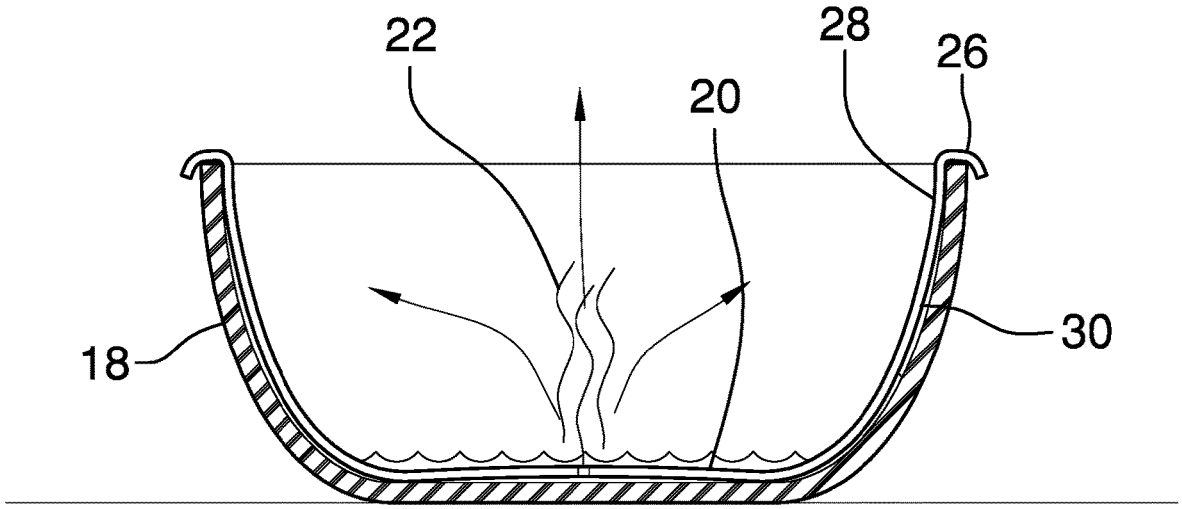
FIG. 4 is a cross sectional view taken along line 4-4 of FIG. 3 of an embodiment of the disclosure.

With reference now to the drawings, and in particular to FIGS. 1 through 4 thereof, a new cleaning device embodying the principles and concepts of an embodiment of the disclosure and generally designated by the reference numeral 10 will be described.

As best illustrated in FIGS. 1 through 4, the steam cleaning system 10 generally comprises an oven 12. The oven 12 has an outer wall 14 and the outer wall 14 has an inside surface 16. The oven 12 may be a microwave oven 12 or the like. A bowl 18 is provided and the bowl 18 selectively contains a liquid 20. The bowl 18 is selectively positioned within the oven 12 thereby facilitating the oven 12 to boil the liquid 20 thereby producing steam 22.

The steam 22 penetrates debris 24 stuck to the inside surface 16 thereby facilitating the debris 24 to be cleaned from the inside surface 16. The debris 24 may be food particles or other organic material that commonly collects in a microwave oven 12. The liquid 20 may be water and the bowl 18 may be comprised of wood. Thus, a microwave oven 12 will not heat the bowl 18 thereby facilitating the bowl 18 to be touched without burning.

A cloth 26 is provided and the cloth 26 is selectively positioned in the bowl 18. The cloth 26 is comprised of a liquid 20 permeable material such that the cloth 26 absorbs the liquid 20. Moreover, the steam 22 is released from the cloth 26 when the oven 12 is turned on to heat the liquid 20. The cloth 26 has a first surface 28 and a second surface 30.

The cloth 26 has a first cut 32 extending through the first surface 28 and the second surface 30. The first cut 32 facilitates the steam 22 to pass through the cloth 26. The cloth 26 has a second cut 34 extending through the first surface 28 and the second surface 30. The second cut 34 intersects the first cut 32 such that the first cut 32 and the second cut 34 forms an X. Additionally, the second cut 34 facilitates the steam 22 to pass through the cloth 26. Each of the first cut 32 and the second cut 34 are centrally positioned on the cloth 26. Additionally, each of the first cut 32 and the second cut 34 may have a length ranging between 2.0 cm and 4.0 cm.

In use, cloth 26 is positioned in the bowl 18 and the liquid 20 is poured into the bowl 18. The cloth 26 absorbs the liquid 20 and the bowl 18 is positioned in the oven 12. The oven 12 is turned on to boil the liquid 20 thereby producing steam 22. The steam 22 penetrates the debris 24 that is stuck to the inside surface 16 of the oven 12. The oven 12 is left on for a period of time ranging between 2.0 minutes and 4.0 minutes. The bowl 18 is removed from the oven 12 when the oven 12 turns off. The inside surface 16 of the oven 12 is wiped clean when the bowl 18 is removed from the oven 12. In this manner the inside surface 16 of the oven 12 is cleaned without the use of chemical cleaners.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A steam cleaning system comprising:

an oven;

a bowl containing a liquid, said bowl being selectively positioned within said oven thereby facilitating said oven to boil the liquid thereby producing steam, said steam being configured to penetrate debris being stuck to said oven thereby facilitating the debris to be cleaned from said oven; and a cloth being positioned in said bowl, said cloth being comprised of a liquid permeable material such that said cloth absorbs said liquid, said steam being released from said cloth when said oven is turned on to heat said liquid, said cloth having a first surface and a second surface, said cloth having a first cut extending through said first surface and said second surface, said first cut facilitating said steam to pass through said cloth.

2. The system according to claim 1, further comprising a second cut extending through said first surface and said second surface, said second cut intersecting said first cut, said second cut facilitating said steam to pass through said cloth.

3. A steam cleaning system comprising:

an oven having an outer wall, said outer wall having an inside surface;

a bowl containing a liquid, said bowl being selectively positioned within said oven thereby facilitating said oven to boil the liquid thereby producing steam, said steam being configured to penetrate debris being stuck to said inside surface thereby facilitating the debris to be cleaned from said inside surface; and a cloth being positioned in said bowl, said cloth being comprised of a liquid permeable material such that said cloth absorbs said liquid, said steam being released from said cloth when said oven is turned on to heat said liquid, said cloth having a first surface and a second surface, said cloth having a first cut extending through said first surface and said second surface, said first cut facilitating said steam to pass through said cloth, said cloth having a second cut extending through said first surface and said second surface, said second cut intersecting said first cut such that said first cut and said second cut forms an X, said second cut facilitating said steam to pass through said cloth.

* * * * *